United States Patent [19]

Chaix et al.

[11] 4,246,961

[45] Jan. 27, 1981

[54] PLATE HEAT EXCHANGER

[75] Inventors: Jean E. Chaix, Manosque; Bernard Chlique, Sceaux; Maurice Fajeau, Pertuis, all of France

[73] Assignees: Commissariat a l'Energie Atomique; Fives-Cail Babcock, both of Paris, France

[21] Appl. No.: 20,090

[22] Filed: Mar. 13, 1979

Related U.S. Application Data

[63] Continuation of Ser. No. 786,561, Apr. 11, 1977, abandoned.

[30] Foreign Application Priority Data

Apr. 12, 1976 [FR] France ..... 76 10696

[51] Int. Cl.[3] ..... F28F 9/22

[52] U.S. Cl. ..... 165/145; 165/157; 165/165; 176/65; 122/32

[58] Field of Search ..... 165/145, 144, 140, 157, 165/165, 104 R; 122/32

[56] References Cited

U.S. PATENT DOCUMENTS

| | | | |
|---|---|---|---|
| 2,395,543 | 2/1946 | Gallaher | 165/145 |
| 2,617,634 | 11/1952 | Jendrassik | 165/140 |
| 2,875,986 | 3/1959 | Holm | 165/145 |

*Primary Examiner*—Albert W. Davis

[57] ABSTRACT

Each heat-exchange bank consists of at least two groups of flat, adjacent compartments provided for the circulation of a second fluid and separated by spaces for the circulation of a first fluid. Each compartment has lateral extensions placed in identical and opposite manner in two adjacent groups. The extensions are connected respectively in each group to a common admission manifold and to a common discharge manifold for the second fluid.

9 Claims, 8 Drawing Figures

PLATE HEAT EXCHANGER

This is a continuation of application Ser. No. 786,561, filed Apr. 11, 1977, now abandoned.

This invention relates to a heat exchanger of the plate exchanger type in which two fluids exchange heat through parallel and especially metallic plates defining spaces which are separated from each other and in which the two fluids circulate respectively without any direct contact with each other.

The invention applies especially to the case in which one of the two fluids is water under pressure or alternatively a circulating liquid metal and especially sodium which is employed in the circuit respectively of a pressurized-water reactor or a fast reactor, the second fluid being water to be vaporized within the heat exchanger as a result of the heat provided by the first fluid.

It is known that, in an application of this type and especially if the first fluid is liquid sodium, one essential requirement consists in preventing any contact between on the one hand the water or the steam and on the other hand the liquid sodium by reason of the extremely hazardous chemical reaction between these two substances. Moreover, the need to vaporize the water as it passes through the heat exchanger calls for large heat-exchange surfaces in all cases whilst the overall size of the installation remains relatively limited. Plate-type heat exchangers are particularly well suited to these conditions and make it possible on the one hand to confine at least one of the two fluids within a series of flat compartments having parallel walls within a leak-tight enclosure in which the second fluid circulates outside the compartments. In respect of a given rate of flow, the structure of said compartments ensures a very large heat-exchange surface through the spaces which are left free between said compartments and through which the first fluid circulates.

The present invention is therefore concerned with a heat exchanger of the type recalled in the foregoing, the arrangement of which is intended to result in small overall size, thus making it possible in particular to mount the heat exchanger within the region located between the core of a nuclear reactor and an outer shell or vessel or alternatively within an outer enclosure with a view to recovering with maximum efficiency the heat gained by a coolant fluid which circulates through the reactor core.

To this end, the heat exchanger under consideration is of the type comprising a plurality of heat-exchange banks each formed by a number of closed flat compartments having parallel walls and separated by spaces forming passages for the circulation of a first fluid. Each compartment is employed for the circulation of a second fluid and is provided with lateral extensions along two opposite sides of the compartment. The distinctive feature of the heat exchanger lies in the fact that each exchange bank is formed by at least two groups of adjacent compartments and each group comprises a number of compartments, the lateral extensions of the compartments being placed in identical manner in each group and in opposite manner in two adjacent groups. Furthermore, said lateral extensions are connected respectively in each group to a common admission manifold and to a common discharge manifold for the second fluid.

By virtue of this arrangement of the compartments in the groups which form the heat-exchange banks and of their extensions in each group, it becomes possible to admit the second fluid into the compartments of the heat-exchange bank and then to discharge said fluid from said compartments by means of manifolds which are not only arranged to serve all the compartments in parallel but also arranged in intercalated relation in order to achieve minimum overall size. This arrangement makes it possible in particular to juxtapose the compartments in each group with an alternate orientation from one group to the next, these groups being themselves separated by an interval which preferably corresponds to the distance between two adjacent compartments in any one group.

In accordance with a particular feature of the invention, the compartments in each group are identical and arranged in opposite orientation from one group to the next with a symmetry with respect to an axial mid-plane at right angles to the plane of the compartments.

In accordance with a number of different alternative embodiments of a heat exchanger in accordance with the invention, the compartments in each group of the heat-exchange bank have either the shape of a parallelogram or the shape of a trapezium, the extensions of said compartments being constituted by the zones of the acute angles of the parallelogram or of the trapezium. In another alternative embodiment, each compartment has the shape of a rectangle, the extensions being constituted by two appendages formed on two opposite sides of said rectangle, either on one and the same third side or on one of the diagonals of the rectangle.

Moreover, in accordance with a further characteristic feature, each manifold which is associated with all the extensions of the compartments in any one group is constituted by a single tube extending through all these compartments, said tube being pierced by orifices for admission or discharge of the second fluid into or from each compartment. Said orifices preferably consist of elongated slots or slits formed in the tube. In another alternative embodiment, each manifold has a non-continuous structure and is constituted by a series of separate tube sections in aligned relation for interconnecting the successive compartments in any one group.

The invention is also concerned with various applications of the heat exchanger in accordance with the invention. Such applications are primarily concerned with different arrangements of said heat exchanger within an enclosure for the containment of the first fluid or within a nuclear reactor vessel. The heat exchanger can advantageously be constituted by a plurality of heat-exchange banks disposed in an annular space within the reactor vessel, thus providing for the possibility of unloading the reactor core or transfer of absorber elements within the reactor. In other alternative embodiments, each heat-exchange bank can be placed either radially or transversely within the reactor vessel or a suitable enclosure.

Further distinctive features of a heat exchanger as constructed in accordance with the invention will become apparent from the following description of a number of exemplified embodiments which are given by way of indication and not in any limiting sense, reference being made to the accompanying drawings, wherein.

As has already become apparent from the foregoing considerations, it will first be recalled that the invention essentially consists in constructing the heat exchanger by means of a number of exchange banks each located next to at least two independent sub-assemblies or groups formed by adjacent compartments which are preferably identical with each other. Each group is associated with a separate admission manifold and with a separate discharge manifold for a second fluid, said manifolds being associated with all the compartments aforesaid. A first fluid circulates in heat-exchange relation with the second fluid which circulates between the compartments. The distance between the groups advantageously corresponds to the interval between two compartments in one and the same group whilst each group is located between the manifolds of the compartments of the adjacent group and conversely.

Figure 1:
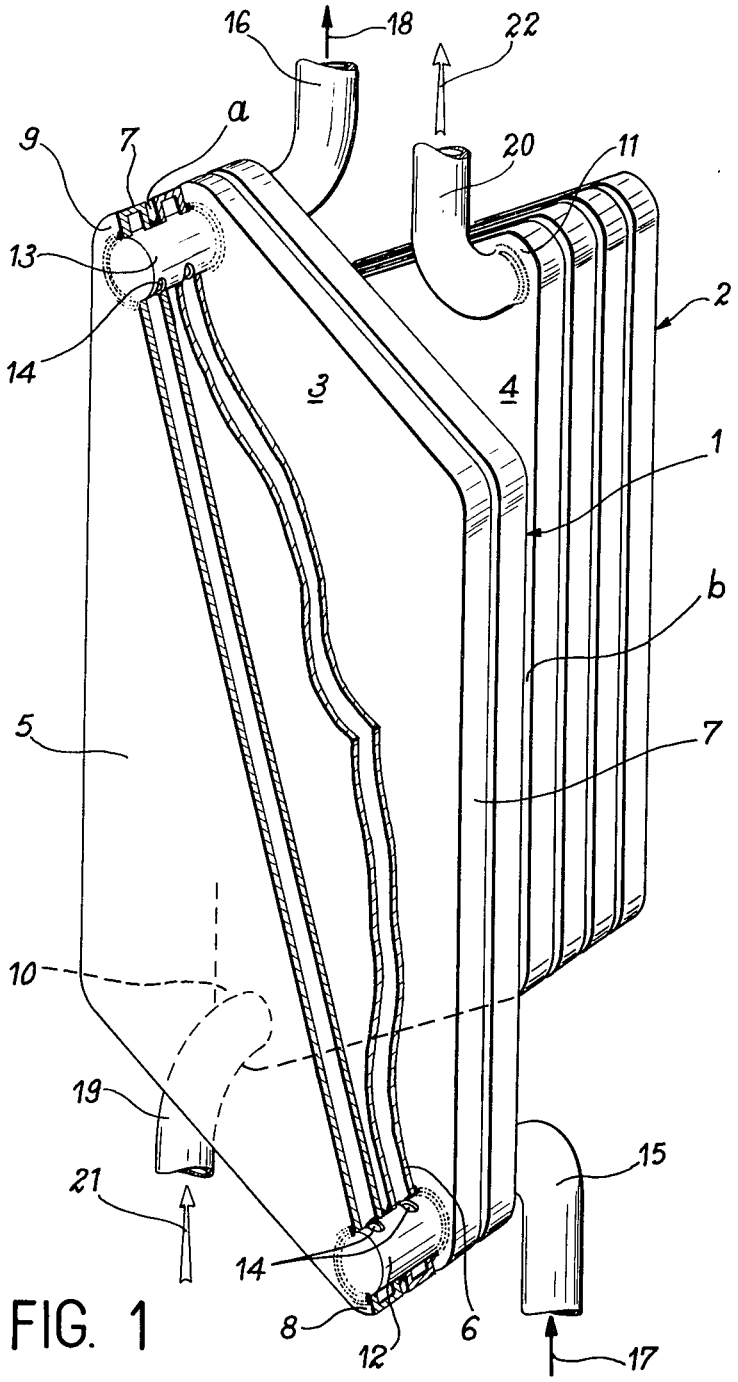
FIG. 1 is a diagrammatic and partially cutaway view in perspective showing a heat-exchange bank in accordance with the invention.
Figure 2:
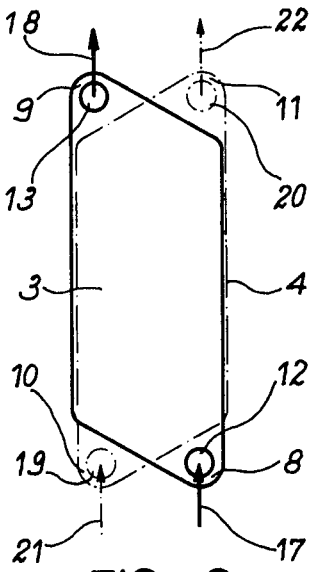
FIGS. 2 to 5 are diagrammatic views in elevation to a smaller scale showing different alternative forms of construction of the heat exchanger under consideration.

Thus, as illustrated in FIG. 1, the heat-exchange bank under consideration is composed of two separate groups 1 and 2 respectively which are each formed by four parallel compartments 3 and 4 respectively, depending on whether they belong to the first or the second group. As shown in the drawings, it should be noted that the first two compartments 3 of group 1 are partially broken away in order to provide a clearer illustration of the structure of said compartments. These latter are advantageously formed by means of two parallel flat plates or sheet metal members 5 and 6 joined to each other by a narrow peripheral strip 7. These elements are joined together especially by welding although it will naturally be understood that any other method of fabrication would be suitable without thereby departing from the scope of the present invention.

Each compartment 3 of group 1, for example, is separated from the adjacent compartments by a narrow space a constituting an open passage for the circulation of a first fluid consisting in particular of a liquid metal and more especially of liquid sodium in the event that the heat exchanger under consideration is employed in the circuit of a fast-neutron reactor. Similarly, the compartments 3 and 4 which form part of the two groups 1 and 2 are separated by a narrow space b which is also provided for the circulation of the first fluid. Said space b advantageously has transverse dimensions which are substantially identical with those of the space a located between the compartments within each group.

In accordance with the invention, each compartment 3 of the first group has two extensions 8 and 9 respectively which are located on two opposite sides of said compartments whilst each compartment 4 of group 2 also has two further extensions 10 and 11 respectively which are again located on two opposite sides but with a reverse orientation with respect to that of the extensions 8 and 9 of the first compartments 3 in group 1.

In each of the groups mentioned above, the compartments 3 and 4 respectively are supplied with a second fluid and especially water. Said second fluid is intended to exchange heat with the first fluid which is circulated within the spaces a and b defined in the foregoing and which is intended to be vaporized in the particular case under consideration. To this end, the compartments 3 of the first group are associated with two manifolds which are common to all these compartments, said manifolds being constituted respectively by two tubes 12 and 13 arranged transversely with respect to the compartments through the extensions 8 and 9 of these latter. Said tubes 12 and 13 are provided within each compartment aforesaid with slits or elongated slots 14 through which the second fluid is discharged from the manifold 12 in liquid form, then passes through each compartment, is collected in the manifold 13 and then discharged from the group of compartments in the form of steam. Said manifolds 12 and 13 are provided with extensions in the form of elbowed tube elements 15 and 16 which, as a result of the orientation of the compartments in the adjacent group 2, can extend respectively above and below the end portions which are left free by the compartments 4. As shown in the drawing, the direction of circulation of the second fluid through the compartments 3 of the first group is shown diagrammatically by the arrow 17 at the admission end and the arrow 18 at the discharge end.

Similarly, the compartments 4 of the second group 2 are associated with two common manifolds 19 and 20 respectively for admission and discharge. The elbowed portions of said manifolds extend outside the compartments below and above the first group, the direction of circulation being shown by the arrows 21 and 22.

FIGS. 2 to 5 illustrate various forms of construction of the compartments 3 and 4 in the two groups which constitute a heat-exchange bank. Thus, the arrangement which was already illustrated in FIG. 1 is again shown in FIG. 2, in which each compartment 3 and 4 has a profile in the shape of a parallelogram. The admission and discharge manifolds pass respectively on the one hand through the extensions 8 and 9 and on the other hand through the extensions 10 and 11 of the compartments. Said manifolds are mounted in two opposite corners of the parallelogram, especially in the region of the acute angles of this latter. It is again apparent from FIG. 2 that the compartments 4 of the second group 2 are so arranged as to have an opposite orientation with respect to the compartments 3 of the first group 1 while conforming to the symmetry with respect to the vertical mid-plane of the heat-exchange bank.

Figure 3:
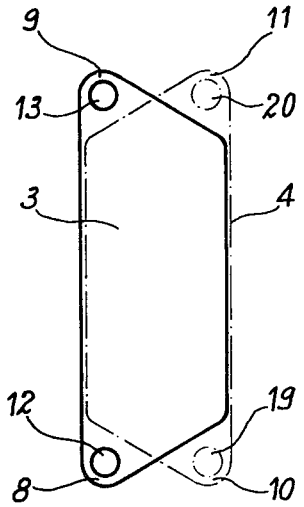

In FIG. 3, each compartment 3 or 4 of the groups 1 and 2 of the heat-exchange bank has the shape of a trapezium. In this form of construction, the extensions 8 and 9 of the compartments 3 are also located in the acute angles of the trapezium whilst the extensions 10 and 11 of the compartments 4 are arranged so as to have an opposite orientation which, as in the previous example, conforms to the symmetry of assembly with respect to the vertical mid-plane of the heat-exchange bank.

Figure 4:
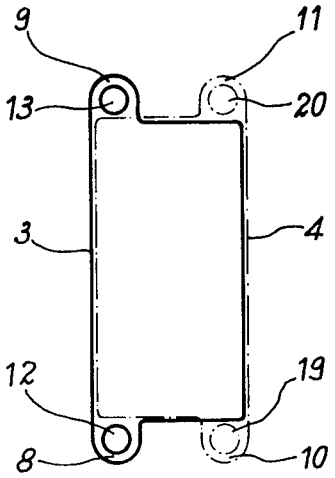
Figure 5:
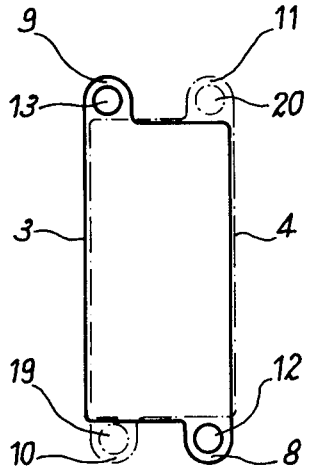

Finally in FIGS. 4 and 5, the compartments 3 and 4 have the shape of rectangles. The extensions designated on the one hand by the references 8 and 9 and on the other hand by the references 10 and 11 are constituted by appendages formed on the short opposite sides of these rectangles. In the alternative embodiment shown in FIG. 4, the appendages of a compartment 3 for example are located on the same side with respect to one of the short sides of the rectangle whereas in FIG. 5, said appendages are located in a diagonal direction of said rectangle.

Whatever embodiment may be adopted, each group of compartments in the heat-exchange bank always has a separate admission manifold and a separate discharge manifold which are provided respectively at the top and bottom of said compartments, the circulation of the second fluid within these compartments being in the upward direction. It is readily apparent that a circulation in the opposite direction could also be provided and that, similarly, the circulation of the first fluid within the passages formed between the compartments of each group and between the groups themselves within the heat-exchange bank could be established either in the same direction or in the direction opposite to the circulation of the second fluid within said compartments.

Figure 6:
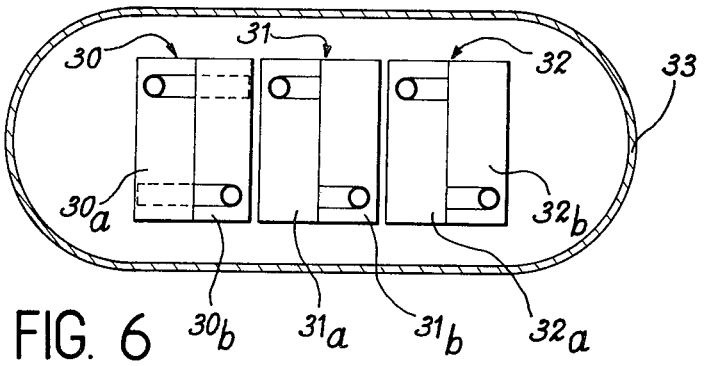
FIGS. 6 to 8 are top views showing the heat exchanger in which a plurality of exchange banks are associated in accordance with any one of the preceding embodiments and in which the heat exchanger is mounted within an enclosure or nuclear reactor vessel.
Figure 7:
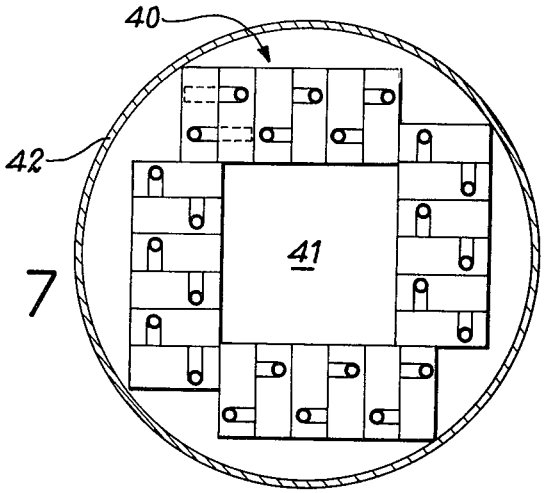
Figure 8:
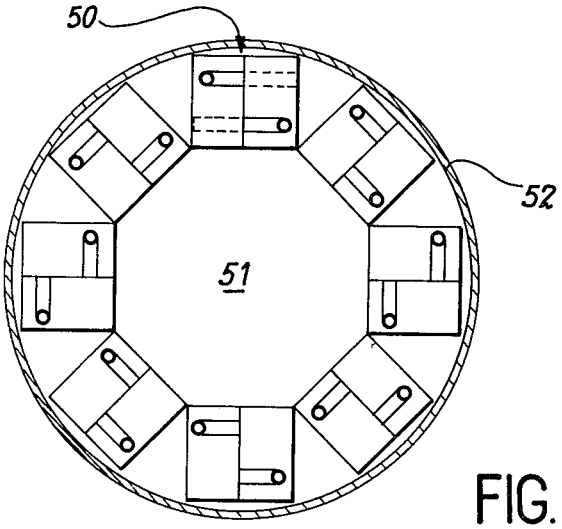

FIGS. 6, 7 and 8 illustrate different alternative forms of assembly of a heat exchanger in accordance with the invention by adopting any one of the embodiments noted in the foregoing, within an enclosure or nuclear reactor vessel, especially for a fast reactor in which liquid sodium is employed as primary coolant, containment of said coolant around the heat-exchange banks being ensured by means of said enclosure or vessel. In the example illustrated in FIG. 6, the heat exchanger is thus made up of three adjacent banks 30, 31 and 32 each made up of two groups designated respectively by the references 30*a*, 30*b*, 31*a*, 31*b*, 32*a*, 32*b*. These groups are themselves formed by flat parallel compartments in accordance with the arrangements provided in the alternative embodiments illustrated in FIGS. 2 to 5. The assembly constituted by the three heat-exchange banks is mounted within an external containment and protection enclosure 33. By means of a suitable arrangement of the admission and discharge manifolds associated with the different groups, the heat exchanger in accordance with this design can be made particularly compact and especially suitable for application to the circuit of a so-called "loop" reactor with steam generators placed within a separate enclosure.

In another alternative embodiment which is illustrated in FIG. 7, the exchange banks of the heat exchanger 40 are arranged so as to form a central space 41 in which it is possible to adapt the core of a nuclear reactor (not shown in the drawings), the complete assembly being contained within a protective vessel 42. In this alternative embodiment, the exchange banks are disposed along the four faces of a right parallelpiped which surrounds the reactor core. If necessary, two adjacent exchange banks can be juxtaposed along part of their external contour, the end face of one bank being placed against a lateral face of the other bank and conversely.

Finally, in the alternative embodiment which is illustrated in FIG. 8, the heat exchanger 50 is constituted by a series of adjacent exchange banks which are eight in number in the example under consideration, each bank being constituted by two groups of compartments. Said heat exchangers are placed radially within a space 51 which is delimited externally by a vessel or protective enclosure 52. The heat-exchange banks are thus arranged in an octogonal configuration whilst the manifolds are placed transversely. In another alternative form of construction which is not illustrated, said manifolds could be placed in a substantially radial position by displacing each heat-exchange bank through an angle of 90°.

In all the constructional designs described and illustrated, it is readily apparent that the first and second fluids may or may not be under pressure. It should further be noted that the design of the heat exchanger which is favorable to a compact arrangement of this latter makes it possible to provide each group with manifolds having dimensions which are inscribed within the limits of the adjacent group or groups by reducing the distance between two adjacent heat exchangers. Moreover, this compact design makes it possible to reduce the useful volumes of fluids which circulate through the heat exchanger and this is particularly advantageous in the case of noble or hazardous fluids.

What we claim is:

1. A plate-type heat exchanger comprising a plurality of exchange banks each formed by a number of closed flat compartments having parallel walls and separated by spaces forming passages for the circulation of a first fluid, each compartment being employed for the circulation of a second fluid and provided with lateral extensions along two opposite sides of said compartment, wherein each heat-exchange bank is formed by at least two adjacent groups of compartments and each group comprises a plurality of adjacent compartments, the lateral extensions of the compartments being placed in identical manner in each group and in opposite manner in two adjacent groups, said lateral extensions being connected respectively in each group to a common admission manifold and to a common discharge manifold for the second fluid and wherein the compartments in each group are identical and arranged in opposite orientation from one group to the next with a symmetry with respect to an axial mid-plane at right angles to the plane of the compartments.

2. A plate-type heat exchanger comprising a plurality of exchange banks each formed by a number of closed flat compartments having parallel walls and separated by spaces forming passages for the circulation of a first fluid, each compartment being employed for the circulation of a second fluid and provided with lateral extensions along two opposite sides of said compartment, wherein each heat-exchange bank is formed by at least two adjacent groups of compartments and each group comprises a number of adjacent compartments, the lateral extensions of the compartments being placed in identical manner in each group and in opposite manner in two adjacent groups, said lateral extensions being connected respectively in each group to a common admission manifold and to a common discharge manifold for the second fluid and wherein the compartments in each group are identical and arranged in opposite orientation from one group to the next with a symmetry with respect to an axial mid-plane at right angles to the plane of the compartments, each manifold being connected with an elbowed tube element, said elbowed tube elements being located above and also under the groups of compartments within places left free by the lateral extension of the compartments.

3. A plate heat exchanger according to claim 2, wherein each compartment of the heat-exchange bank has the shape of a parallelogram, the compartment extensions being formed by the zones of the two acute angles of the parallelogram.

4. A plate heat exchanger according to claim 2, wherein each compartment of the heat-exchange bank has the shape of a trapezium, the compartment extensions being formed by the zones of the two acute angles of the trapezium.

5. A plate heat exchanger according to claim 2, wherein each compartment of the heat-exchange bank has the shape of a rectangle, the compartment extensions being constituted by two appendages formed on two opposite sides of the rectangle.

6. A plate heat exchanger according to claim 5, wherein the two appendages are formed respectively on two opposite sides of the rectangle on one and the same edge with respect to a third side.

7. A plate heat exchanger according to claim 5, wherein the two appendages are formed on two opposite sides of the rectangle on a diagonal of said rectangle.

8. A plate heat exchanger according to claim 2, wherein each manifold which is associated with all the extensions of the compartments in any one group is constituted by a single tube extending through all of said compartments, said tube being pierced by orifices for admission or discharge of the second fluid into or from each compartment.

9. A plate heat exchanger according to claim 2 wherein each manifold which is associated with all the extensions of the compartments in any one group has a non-continuous structure and is constituted by a series of separate tube sections in aligned relation for interconnecting the successive compartments in any one group.

* * * * *